US007245731B2

(12) United States Patent
Niederdränk et al.

(10) Patent No.: US 7,245,731 B2
(45) Date of Patent: Jul. 17, 2007

(54) DEVICE AND METHOD FOR COMMUNICATION OF HEARING AIDS

(75) Inventors: Torsten Niederdränk, Erlangen (DE); Gottfried Rückerl, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 341 days.

(21) Appl. No.: 10/772,700

(22) Filed: Feb. 5, 2004

(65) Prior Publication Data

US 2005/0089183 A1 Apr. 28, 2005

(30) Foreign Application Priority Data

Feb. 5, 2003 (DE) ..... 103 04 648

(51) Int. Cl.
*H04R 25/00* (2006.01)

(52) U.S. Cl. ..... 381/315; 381/23.1

(58) Field of Classification Search ..... 381/23.1, 381/315; 370/444; 455/512
See application file for complete search history.

(56) References Cited

U.S. PATENT DOCUMENTS

| | | | | |
|---|---|---|---|---|
| 4,920,570 | A | 4/1990 | West et al. | |
| 5,541,919 | A | 7/1996 | Yong et al. | |
| 5,867,731 | A * | 2/1999 | Williams et al. | 710/29 |
| 6,240,194 | B1 * | 5/2001 | De Koning | 381/315 |
| 6,467,059 | B1 | 10/2002 | Ohashi | |
| 7,020,296 | B2 | 3/2006 | Niederdränk | |
| 2003/0133582 | A1 | 7/2003 | Niederdrank | |
| 2004/0165731 | A1 | 8/2004 | Ribic | |

FOREIGN PATENT DOCUMENTS

| | | | |
|---|---|---|---|
| CN | 114 1106 | | 7/1996 |
| DE | 35 27 112 | | 1/1987 |
| DE | 35 27 112 | A1 | 1/1987 |
| DE | 195 44 546 | A1 | 11/1995 |
| DE | 199 07 085 | C1 | 4/2000 |
| DE | 102 01 068 | A1 | 1/2002 |
| JP | A-6-252928 | | 9/1994 |
| JP | A-11-355324 | | 12/1999 |
| WO | WO 9748249 | A1 * | 12/1997 |
| WO | WO 99/03254 | | 1/1999 |
| WO | WO 00/00001 | | 1/2000 |
| WO | WO 02/07479 | | 1/2002 |
| WO | WO 02/28143 | A2 | 4/2002 |
| WO | WO 02/089520 | A2 | 8/2004 |

* cited by examiner

*Primary Examiner*—Daniel Swerdlow
(74) *Attorney, Agent, or Firm*—Schiff Hardin LLP

(57) ABSTRACT

An energy-saving communication is made available in a hearing aid system. For this purpose the individual communication participants are given different priorities, by using data packets of variable length in the communication. The longer data packets of higher priority prevail when the transmission requests of lower priority are paused as long as the communication channel is busy. In this manner a suitable communication can be structured in a hearing aid system comprising, for example, of two hearing aids and a remote control.

32 Claims, 2 Drawing Sheets

Data packets for the binaural balance of the hearing aid parameters
Acknowledgement
Binural balance signal processing
Program/volume information of hearing aid
Program/volume information of remote control
Single short data packet DP for volume/program

DEVICE AND METHOD FOR COMMUNICATION OF HEARING AIDS

BACKGROUND OF THE INVENTION

The present invention relates to methods and devices for the sending of data in a hearing aid system.

Wireless communication between one hearing aid and another hearing aid as well as with an additional communications interface must fulfill special requirements, which, for example, are caused by the very limited available transmission energy of a transceiver located in the hearing aid as well as by the antennae, which are frequently quite ineffective due to spatial limitations.

The solutions implemented in other application fields resort, on the one hand, to multiple channels or time-slicing procedures. If, on the other hand, a single-channel communication system is used, in the case of sufficient transmitting ranges and transmission bandwidths of all the involved communication participants, it is possible as a rule to ensure that the wireless communication channel is free in the case of the use of a communication procedure. For energy and spatial reasons, these methods, which find application for example in modern digital communication systems (Bluetooth, DECT, etc.), are not suitable for hearing aid applications. The FM communication systems common in the field of hearing aids as a rule represent pure point-to-point communication systems with a communication level for a single application, which continuously transmit analog signals.

In this connection, a hearing aid with several analog inputs and one additional digital input is known from German patent publication DE 195 44 546. It is possible to further process several digital signals fed in at the additional input of the hearing aid by way of a multiplexer and to lead said digital signals to a signal processor of the hearing aid.

By way of this procedure, the spatially separate microphone signals of stereo microphones can be received and further processed quickly and error-free in a digital manner.

Additionally, in the German patent publication DE 102 01 068, a method for communication of a hearing aid with external radio interfaces is described, in which address data and/or channel data regarding several signal sources are stored in a memory device. By way of a priority-driven address management system, the hearing-aid wearer can very comfortably automatically pick up communication with a radio interface of the highest priority.

SUMMARY OF THE INVENTION

The object of the present invention thus comprises creating a communication system for hearing aids which fulfills the special requirements and is optimized, particularly with regard to energy consumption.

In accordance with the invention, this task is solved by a method for sending data in a hearing aid system by way of the assignment of a priority for a send operation and sending a data packet with a length as a function of the assigned priority.

A corresponding device for the sending of data for a hearing aid system has an assigning device for assigning a priority for a send operation, a preparation device for preparation of the data to be sent in a data packet with a length as a function of the assigned priority, and a sending device for sending the prepared data.

As per the present invention it is thus possible to assign priority to the manual control of a hearing aid before other communications between the hearing aids, by way of giving the highest priority to the data to be transmitted on the basis of the operation and thus the largest data packet length. Consequently those components of the hearing aid system which receive such a high priority message must stop their send activity, at least for a certain period of time. For this reason, in accordance with an embodiment of the invention, a procedure in this connection is provided for the sending of data in a hearing aid system by way of the sending of data of a first priority, the receiving of data of a second priority and temporary termination of the sending, in case the second priority is higher than the first priority.

A corresponding device for the sending of data for a hearing aid system is implemented by a sending device for the sending of data of a first priority, a receiving device for the reception of data of a second priority, and a controller which is connected to the sending device and the receiving device for the temporary termination of the sending by way of the sending device, in case the second priority is higher than the first priority.

This proceeds from a communication system on the basis, for example, of an electromagnetic, infra-red or ultrasound communication, which, subject to cost and on the basis of a limited transmission capacity, does not have access to several communication channels or a division according to a time-slicing procedure. The transmission signals are preferably transferred via a single communication channel.

In principle such a communication system can have at least two logical levels of communication at its disposal, which can each be assigned to different applications or transmission modalities. In accordance with the application, these communication levels will have different priorities of communication. Additionally, more than two communication participants can be involved in the communication network, who are not necessarily informed of everything about the current communication of the other participants. For example, if an exchange of data takes place between two hearing aids, on the basis of the restricted range of the hearing aids, a remote control may not have any information about a current communication. If, at a particular time, a perhaps time-critical application of a higher communication level or a participant not continuously linked transmits a signal to be wirelessly transmitted upon request, in the case of a currently running communication, this communication can be interrupted and the sent data of both the interrupted connection as well as that of the application of higher priority or of the external source can be lost. For the communication system, there is a requirement that the data of the communication of higher priority do not get lost. For this reason, data packets of variable length are used in communication. The data packets of higher priority prevail when the transmission requests of lower priority are paused as long as the communication channel is busy.

DESCRIPTION OF THE DRAWINGS

The present invention is described in greater detail using the attached figures illustrating exemplary embodiments.

DETAILED DESCRIPTION OF THE PREFERRED EMBODIMENTS

Figure 1:
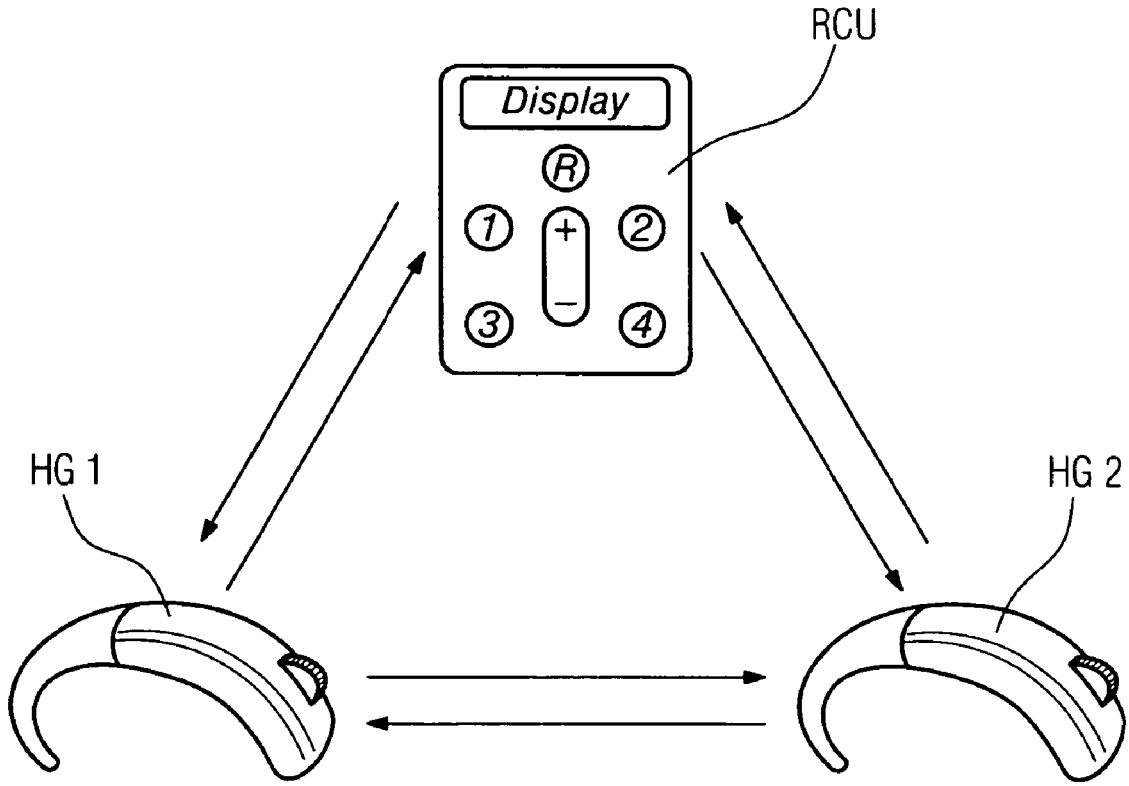
FIG. 1 is a schematic diagram of a hearing aid system with two hearing aids and a remote control.

The present exemplified embodiments described below represent specific embodiments of the present invention.

The communication levels or communication partners of different priority may use distinctly different data packets. If a base data word (DW) is used in the lowest level for communication, these data records will be sent between the partners in the case of no error. If an application or a participant of a higher priority now appears, the current communication should be interrupted and the necessary information exchanged. To this end, the application of higher priority may send data packets that are significantly longer than those of the application of lower priority.

In the case of the uncoordinated arrival of the words of higher priority, the current communication is disturbed at first, since the receiving communication user receives the overlay of the original send signal and of the additional signal. As a result of the time length of the send signal of higher priority, however, after the completed send operation, the lower priority connection is able to receive a part of the new send signal free of disturbance. For this reason, preferably, the send signal of the communication element of higher priority is built out of a first and a second block, where the second block contains the complete information to be transferred and even in extreme conditions can still be received after a completed transfer of the first block.

Depending on whether the transfer contains absolute instructions (e.g., volume level 3) or relative instructions (e.g., increase of the volume by one level), the first part of the data packet can comprise either at least one of the data words to be sent or of a combination of preambles. In the case of the transfer of absolute data, the advantage of transferring the data word DW as the first part of the data packet is that for the case of an error-free transfer of the data, the data can be detected earlier. A transfer of relative instructions can not take place twice in a data packet, since in the case of error-free transfer, for example, an increase of a value, would otherwise have to be performed twice.

If sequences of preambles are sent in advance, these preambles do not contain any information, they merely indicate to the system that soon a data transfer will take place. During the reception of important data or preambles, all the subscribers of lower priority will be prevented from starting up their own communication. Even when the transfer of higher priority has been completed, the communication channel will reserve a specific time $T_{ack}$ before a transmission at a lower-order level can take place.

In general, if a transmission of the priority of N is executed, the data packets have a minimum length of {(N+1)DW}. The priority rises with increasing number N. Assuming no more than one communication within a priority level, the most important communication can in this way take place free of error. If subscribers who do not have any information about the running communications possess a higher priority, they can introduce their data into the communication system.

One specific embodiment in accordance with the present invention can be implemented as shown in FIG. 1 by way of a wireless system for hearing aid applications. The system may comprise two hearing aids HG1, HG2, and a remote control unit RCU, which communicate with each other wirelessly. Due to the limited send energy of the hearing aids HG1, HG2 the transmission ranges are limited. The remote control RCU is not integrated in the communication of the two hearing aids.

Additionally there are different communication levels. The lowest level represents the binaural balance of the hearing aids 1, 2 with regard to the signal processing algorithms. For example, the hearing programs to be used in both hearing aids 1, 2 are balanced by this mechanism.

An application of higher priority may be the operation of the manual operating elements on the hearing aid by way of the hearing aid carrier. In the case of an such operation, any other communication should be immediately interrupted and the binaural balance of the operating element settings should be performed. The transmission of the control values takes place with absolute values. The data packets comprise accordingly a double transmission of the original data word.

If an operation of the remote control RCU appears, the current communication is again interrupted and the desired remote control function is implemented, since a very high priority is also given to the operation of the remote control RCU. In the process, frequently relative instruction sets may be resorted to, whereby a series of preambles is placed in front of the data word.

The exemplary timing of the transmission is illustrated in FIG. 2 through FIG. 6. It is to be recognized that in the case of a communications conflict, the communication having a higher priority disrupts the communication having a lower priority, resulting in a termination of the lower priority communication and transmission of the higher priority communication data.

Figure 2:
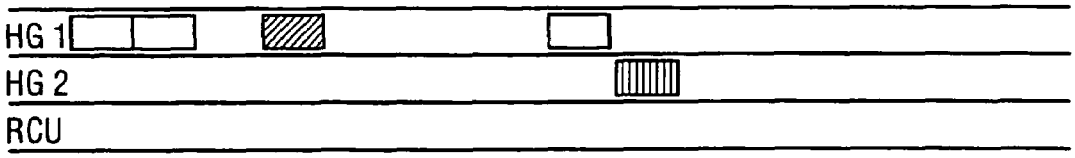
FIG. 2 is a timing diagram illustrating a time signaling scheme with manual control.

For example, if as per FIG. 2, a transmission is generated on the basis of a manual control, absolute data packets from hearing aid HG1 are transmitted doubly to the other hearing aid HG2. The user data are transmitted in a first part and again in a second part of the data packet. As is the case with any data packet, an initialization preamble may be placed in front of both parts (the preamble is not shown in any of the figures for the sake of clarity).

If a further operation appears within a certain period of time $T_{ack}$, the corresponding data word only has to be sent once, since other communication users of lower priority are silent for at least a $T_{ack}$ period of time before additional transmissions are initiated. After this time $T_{ack}$ the operated device then sends a complete synchronization instruction for binaural balance, which is answered by the other user HG2 with an acknowledgement. In this manner, the settings, e.g., volume control or program selection, which are performed manually on hearing aid HG1, can be wirelessly transmitted to hearing aid HG2. The acknowledgement time $T_{ack}$ can be variable for the two hearing aids HG1 and HG2.

Figure 3:
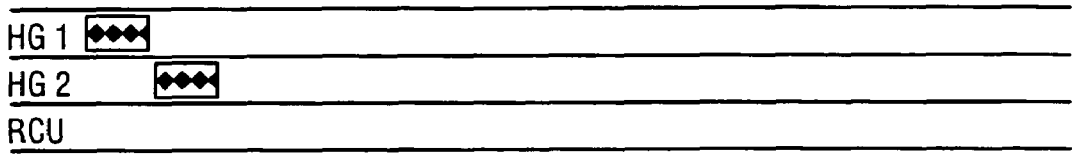
FIG. 3 is a timing diagram illustrating a time signaling scheme with automatic synchronization of the signal processing.

FIG. 3 shows a time signaling scheme for the case of an automatic synchronization of the signal processing. First, hearing aid HG1 sends a data packet for balance. After that, the additional hearing aid HG2, which is also in the hearing aid system, sends a synchronization data packet for balance. In this way, those control values which the signal processing has determined to be optimal for each hearing aid are alternately transmitted either way to the hearing aids. However, to avoid differing hearing aid settings on the basis of the different locations of the hearing aids, a corresponding balancing takes place.

Additionally, the binaural information can be used for control of the signal processing algorithms, e.g., of a background noise suppression.

Figure 4:
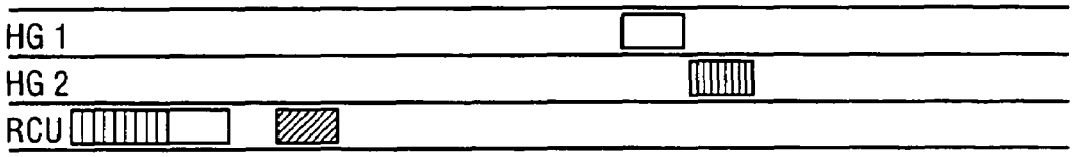
FIG. 4 is a timing diagram illustrating a time signaling scheme with remote control.

If, as shown in FIG. 4, in a send operation of the remote control (which, as a result of the limited range of the hearing aid communication, has no knowledge of current communication procedures), the remote control may first transmit a sequence of preambles in a first part, before the actual user data word follows in a second part of the data packet. An initialization preamble, which is not shown in the figures, is again placed in front of the two parts.

Since the hearing aids should respond immediately to the remote control, a very high priority is granted to the data packets of the remote control, which is translated by way of the great length of the first data packet sent by the remote control. After this, high priority message hearing aids HG1 and HG2 are also prevented from sending for a pre-specified period of time. During this time, the remote control can easily transmit short data packets, for example, for the volume control and program selection, to the hearing aids. After the send pause forced on the hearing aids, a balancing again takes place between the hearing aids, as already described in connection with FIG. 2. This balancing ensures that both hearing aids HG1 and HG2 have also received the instructions from the remote control.

Figure 5:
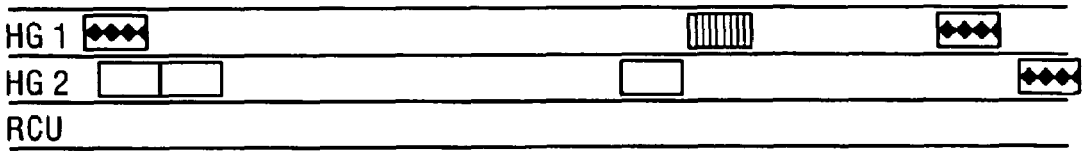
FIG. 5 is a timing diagram illustrating a time signaling scheme of a synchronization of the signal processing with simultaneous manual control.

FIG. 5 shows the case of a manual control taking place during the synchronization of the signal processing of both hearing aids. In this case, hearing aid HG1 sends a conventional synchronization data packet for balancing of the signal processing. During the sending of this synchronization data packet, the manual control on hearing aid 2 starts, so that hearing aid HG2 sends an extended data packet in order to terminate the synchronization operation.

The transmission of the control values by way of the manual control on hearing aid HG2 gains the highest priority. The data word transferred at the end of the data packet can thus be received without trouble by hearing aid 1. After the time period $T_{ack}$ passes, an acknowledgement or synchronization operation again takes place, in which the data word containing the control value of the manual control is again sent by hearing aid 2 and then acknowledged by hearing aid 1. After that, the synchronization operation of the signal processing takes place, as in FIG. 3.

Figure 6:
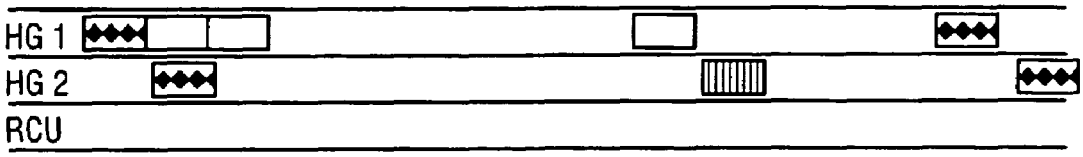
FIG. 6 is a timing diagram illustrating a time signaling scheme of a synchronization of the signal processing with time deferred manual control as opposed to FIG. 5.

FIG. 6, on the other hand, shows a case in which the synchronization of the signal processing is interrupted by way of manual control. In this case the manual control on hearing aid HG1 takes place and is chronologically after the synchronization data packet of hearing aid HG1. The desired control value of the manual control is also transmitted twice here for priority reasons. Since the manual control or its transmission of the desired control value does not start until after the synchronization data packet, hearing aid HG2 begins answering with its own synchronization data packet. The two send operations overlap in this case, so that even the second data word for transmission of the control value of the manual control, which is sent by hearing aid HG1, is partially overlaid by the send operation of hearing aid HG2. Both data words cannot be received free of error by hearing aid HG2. Since however, as usual, after a certain period of time, a balance of the set hearing aid parameters is performed in which the hearing aid HG1 sends the control value a second time, hearing aid HG2 is now given the opportunity to completely receive the data packet. Hearing aid HG2 acknowledges this reception accordingly. Since the synchronization of the signal processing also cannot be completed here, it takes place after the balance of the hearing aid parameters in normal fashion.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A method for sending data in a hearing aid system, comprising:

assigning a priority for a send operation based on an operational function of the data to be sent;

assembling a data packet with a length, the length being a function of the assigned priority; and sending the data packet.

2. The method according to claim 1, further comprising:

receiving data of a second priority; and temporarily terminating the sending of the data packet, if the second priority is higher than the assigned priority.

3. The method according to claim 1, wherein a manual control process causes a send with the highest priority.

4. The method according to claim 1, further comprising:

synchronizing two hearing aids in the hearing aid system with data packets of a lowest priority.

5. The method according to claim 1, wherein only a single communication channel is available in the hearing aid system.

6. The method according to claim 1, further comprising:

structuring a first part of the data packet to comprise user data or a preamble; and structuring a second part of the data packet to comprise at least one of the same user data and other user data.

7. The method according to claim 1, wherein the data packet has a length of (N+1) data words, with N defining the priority as a whole number.

8. The method according to claim 1, further comprising:

reserving a communication channel for a predefined period of time after a send with the highest priority.

9. A device for sending data for a hearing aid system, comprising:

an assigning device configured for assigning a priority for a send operation based on an operational function of the data to be sent;

a preparation device configured for preparing data to be sent in a data packet with a length, the length being a function of the assigned priority; and a sending device configured for sending the prepared data.

10. The device according to claim 9, further comprising:
a reception device configured to receive data of a second priority; and
a controller, which is connected with the sending device and the reception device, configured to temporarily terminate the send operation through the sending device in case the second priority is higher than the assigned priority.

11. The device according to claim 9, wherein a highest priority can be assigned with the assigning device when a manual control is registered with the preparation device.

12. The device according to claim 9, wherein a lowest priority can be assigned with the assigning device when synchronization data for synchronizing two hearing aids are prepared with the preparation device.

13. The device according to claim 9, wherein only a single communication channel is available in the hearing aid system.

14. The device according to claim 9, further comprising a configuration attribute permitting integration into a hearing aid or remote control.

15. The device according to claim 9, wherein a first part of the data packet comprises user data or a preamble and a second part contains at least one of the same user data and other user data.

16. The device according to claim 9, wherein the data packet has a length of (N+1) data words, with N defining the priority as a whole number.

17. The device according to claim 9, further comprising:
a controller for controlling the sending device so that after a send with a highest priority in the hearing aid system, the sending device can be switched to inactive for a predefined time.

18. A method for sending data in a hearing aid system, comprising:
assigning priority to data based on an operation function of the data to be sent;
sending data of a first priority;
receiving data of a second priority coincident with the sending of data of the first priority; and
temporarily terminating the send if the second priority is higher than the first priority.

19. The method according to claim 18, wherein only a single communication channel is present in the hearing aid system.

20. The method according to claim 18, further comprising:
constructing a first part of the data packet to comprise user data or a preamble; and
comprising a second part of the data packet to comprise at least one of the same user data and other user data.

21. The method according to claim 18, wherein the data packet has a length of (N+1) data words, with N defining the priority as a whole number.

22. The method according to claim 18, further comprising:
reserving a communication channel for a predetermined time after a send with a highest priority.

23. A device for sending data for a hearing aid system, comprising:
a device configured for assigning priority to data based on an operation function of the data to be sent;
a sending device configured for sending a data packet of a first priority;
a reception device configured for receiving data of a second priority coincident with the sending of data of the first priority; and
a controller, which is connected with the sending device and the reception device, for the temporary termination of the send operation through the sending device in case the second priority is higher than the first priority.

24. The device according to claim 23, whereby only a single communication channel is available in the hearing aid system.

25. The device according to claim 23, further comprising a configuration attribute permitting integration into a hearing aid or remote control.

26. The device according to claim 23, wherein a first part of the data packet comprises user data or a preamble, and a second part of the data packet contains at least one of the same user data and other user data.

27. The device according to claim 23, wherein the data packet has a length of (N+1) data words, with N defining the priority as a whole number.

28. The device according to claim 23, wherein, after a reception of data of a highest priority, the controller is configured to switch the sending device to inactive for a predefined period of time.

29. A hearing aid comprising:
a device for sending data for a hearing aid system, the device comprising:
an assigning device configured for assigning a priority for a send operation based on an operational function of the data to be sent;
a preparation device configured for preparing data to be sent in a data packet with a length, the length being a function of the assigned priority; and
a sending device configured for sending the prepared data.

30. A hearing aid comprising:
a device for sending data for a hearing aid system, the device comprising:
an assignment device configured for assigning priority to data based on an operation function of the data to be sent;
a sending device configured for sending a data packet of a first priority;
a reception device configured for receiving data of a second priority coincident with the sending of data of the first priority; and
a controller, which is connected with the sending device and the reception device, for the temporary termination of the send operation through the sending device in case the second priority is higher than the first priority.

31. A remote control comprising:
a device for sending data for a hearing aid system, the device comprising:
an assigning device configured for assigning a priority for a send operation based on an operation function of the data to be sent;
a preparation device configured for preparing data to be sent in a data packet with a length, the length being a function of the assigned priority; and
a sending device configured for sending the prepared data.

32. A remote control comprising:
a device for sending data for a hearing aid system, the device comprising:
a device configured for assigning priority to data based on an operation function of the data to be sent;
sending device configured for sending a data packet of a first priority;

a reception device configured for receiving data of a second priority coincident with the sending of data of the first priority; and a controller, which is connected with the sending device and the reception device, for the temporary termination of the send operation through the sending device in case the second priority is higher than the first priority.

* * * * *